US011841128B2

(12) United States Patent
Lindley et al.

(10) Patent No.: US 11,841,128 B2
(45) Date of Patent: Dec. 12, 2023

(54) DETACHABLE LANTERN LIGHTING DEVICE

(71) Applicant: LB Marketing, Inc., Alpharetta, GA (US)

(72) Inventors: Lauren Lindley, Alpharetta, GA (US); Kaif Dosani, Alpharetta, GA (US); Douglas R. Kaye, Alpharetta, GA (US); Thomas Perrin, Alpharetta, GA (US); Kelly Dawn Hires, Alpharetta, GA (US)

(73) Assignee: LB MARKETING, INC., Alpharetta, GA (US)

( * ) Notice: Subject to any disclaimer, the term of this patent is extended or adjusted under 35 U.S.C. 154(b) by 0 days.

(21) Appl. No.: 17/978,129

(22) Filed: Oct. 31, 2022

(65) Prior Publication Data

US 2023/0137703 A1 May 4, 2023

Related U.S. Application Data

(60) Provisional application No. 63/273,336, filed on Oct. 29, 2021.

(51) Int. Cl.

| | |
|---|---|
| ***F21V 15/01*** | (2006.01) |
| ***F21L 4/08*** | (2006.01) |
| *F21Y 115/10* | (2016.01) |

(52) U.S. Cl.

CPC ..... *F21V 15/012* (2013.01); *F21L 4/08* (2013.01); *F21Y 2115/10* (2016.08)

(58) Field of Classification Search

CPC ..... F21V 15/012; F21V 23/06; F21L 4/08; F21L 2/00; F21S 2/005

See application file for complete search history.

(56) References Cited

U.S. PATENT DOCUMENTS

| | | | | |
|---|---|---|---|---|
| 6,819,080 | B2 * | 11/2004 | Barbeau | F21S 9/022 320/114 |
| 9,217,548 | B2 * | 12/2015 | Shen | F21L 4/027 |
| 9,222,633 | B2 * | 12/2015 | Inskeep | F21S 9/02 |
| 10,041,635 | B2 * | 8/2018 | Lam | F21L 4/027 |
| 11,092,320 | B2 * | 8/2021 | Harvey | F21V 21/16 |
| 2011/0012518 | A1 * | 1/2011 | Tarter | F21L 4/027 315/160 |
| 2015/0285449 | A1 * | 10/2015 | Hajee | F21S 9/037 362/183 |
| 2018/0135819 | A1 * | 5/2018 | Grandadam | F21V 21/02 |

* cited by examiner

*Primary Examiner* — Tracie Y Green
*Assistant Examiner* — Michael Chiang
(74) *Attorney, Agent, or Firm* — Thomas Horstemeyer, LLP

(57) ABSTRACT

A lantern lighting device is disclosed that can include a lantern and a base that can be configured to retain the lantern, where the base can include a light emitting element, which can be independent to a light emitting element of the lantern. The lantern lighting device can include a base comprising a base power supply and a base light emitting element, and a lantern detachably attached to the base. The lantern can comprise a lantern lighting element and a lantern power supply. The base can be configured to illuminate the base light emitting element when the lantern is detached from the base, and de-illuminate the base light emitting element when the lantern is detachably attached to the base.

20 Claims, 11 Drawing Sheets

Assembled Lantern Lighting Device

Lantern Rotated 45° Relative to Base

Lantern Removed

DETACHABLE LANTERN LIGHTING DEVICE

CROSS-REFERENCE TO RELATED APPLICATIONS

This application claims the benefit of U.S. Provisional Patent Application No. 63/273,336, filed Oct. 29, 2021, the contents of which being incorporated by reference in their entireties herein.

BACKGROUND

Area lights, such as lanterns and work lights, have existed for decades with little to no innovation. Traditionally, lanterns, such as those used in camping and other recreational activities, must be operated by hand and must be repeatedly adjusted to fix an angle of illumination. Continuously moving a lantern from one area to another during a project is not ideal and can be cumbersome. Additionally, it is difficult to orient the illumination provided by a lantern and lanterns tend to be bulky such that they cannot be used in many spaces and various applications. Also, for difficult areas to illuminate, lanterns require use of a hand of an operator, preventing the operator from utilizing both hands to complete a task.

FIELD OF THE INVENTION

The present invention relates to portable lighting devices. More specifically, the present invention relates to a portable lantern lighting device having an independently illuminating base.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

The present disclosure relates to a lantern lighting device having independently illuminating and removable auxiliary lighting devices. As noted above, area lights, such as lanterns and work lights, have existed for decades with little to no innovation. Traditionally, lanterns, such as those used in camping and other recreational activities, must be operated by hand and must be repeatedly adjusted to fix an angle of illumination. Continuously moving a lantern from one area to another during a project is not ideal and can be cumbersome. Additionally, it is difficult to orient the illumination provided by a lantern and lanterns tend to be bulky such that they cannot be used in many spaces and various applications. Also, for difficult areas to illuminate, lanterns require use of a hand of an operator, preventing the operator from utilizing both hands to complete a task.

According to various embodiments described herein, a lantern lighting device is disclosed that includes a lantern and a base configured to couple to and/or retain the lantern, where the base has a light emitting element independent that of the lantern. The lantern lighting device may include a base comprising a base power supply and a base light emitting element, and a lantern detachably attached to the base, the lantern comprising a lantern lighting element and a lantern power supply. The base is configured to illuminate the base light emitting element when the lantern is detached from the base, and de-illuminate the base light emitting element when the lantern is detachably attached to the base.

Figure 1:
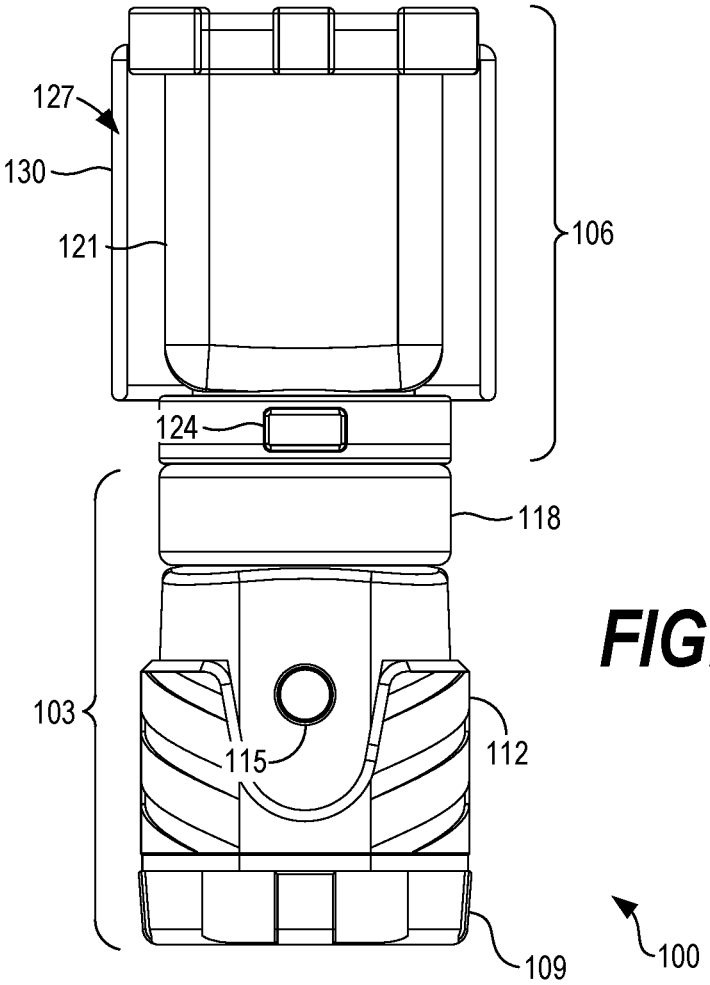
FIG. 1 is a front view of a lantern lighting device including a base and a lantern in accordance with various embodiments of the present disclosure.
Figure 2:
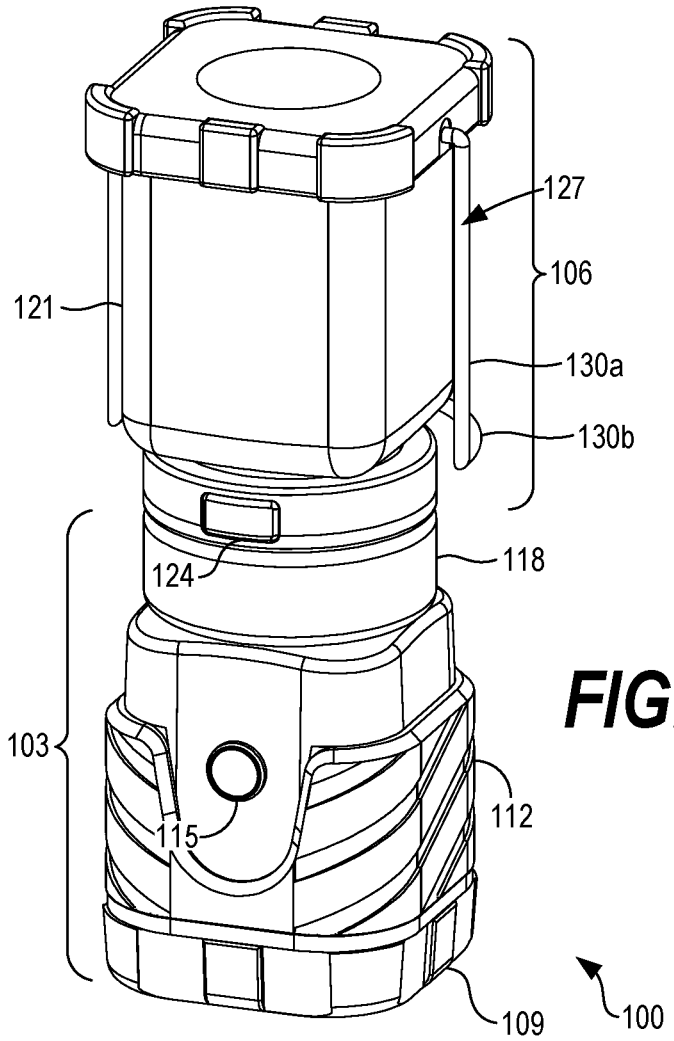
FIG. 2 is a front perspective view of the lantern lighting device including the base and the lantern in accordance with various embodiments of the present disclosure.
Figure 3:
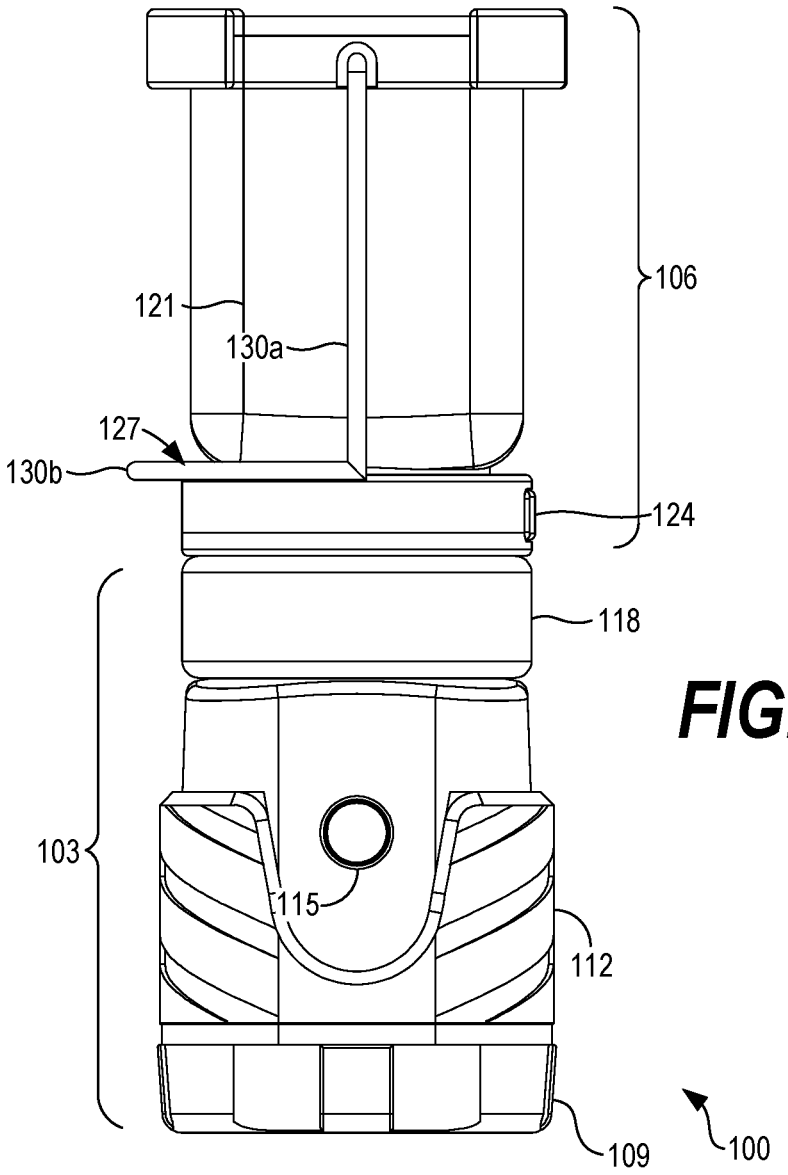
FIG. 3 is a side view of the lantern lighting device including the base and the lantern in accordance with various embodiments of the present disclosure.
Figure 4A:
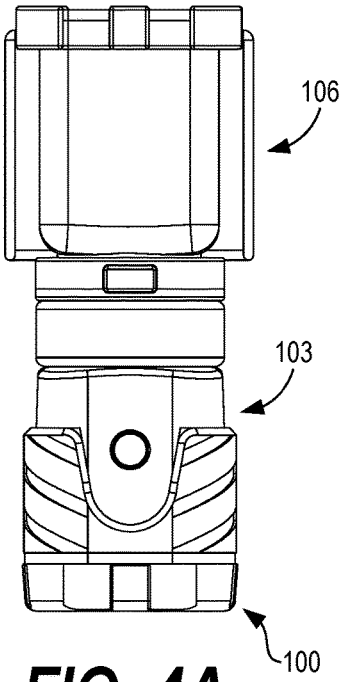
FIGS. 4A-4C show a sequence of removal of the lantern from the base of the lantern lighting device in accordance with various embodiments of the present disclosure.
Figure 4B:
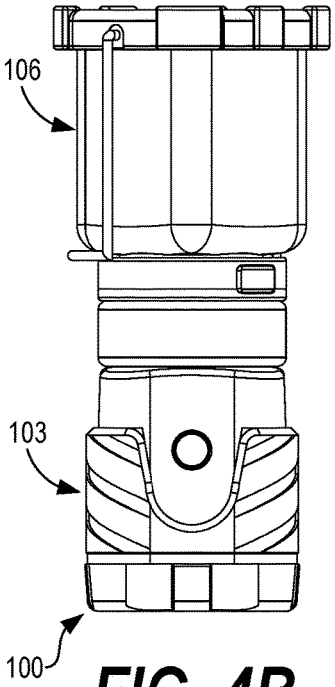
Figure 4C:
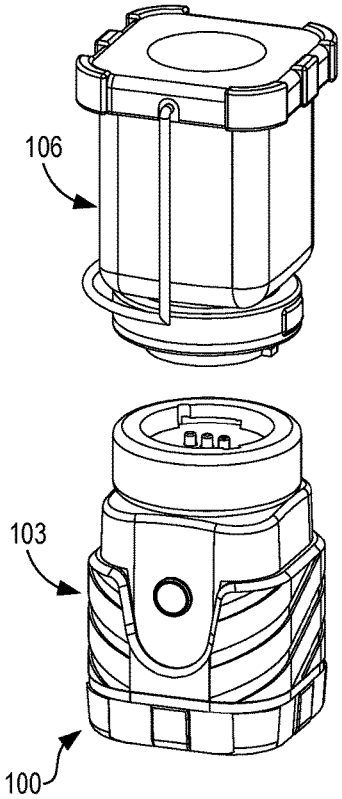
Figure 5A:
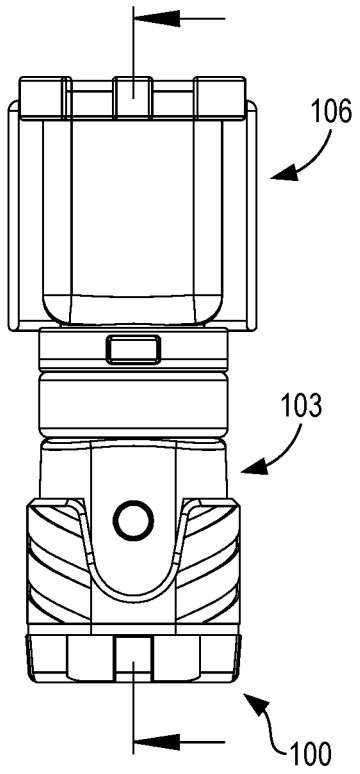
FIGS. 5A-5B show a sequence of removal of the lantern from the base of the lantern lighting device in accordance with various embodiments of the present disclosure.
Figure 5B:
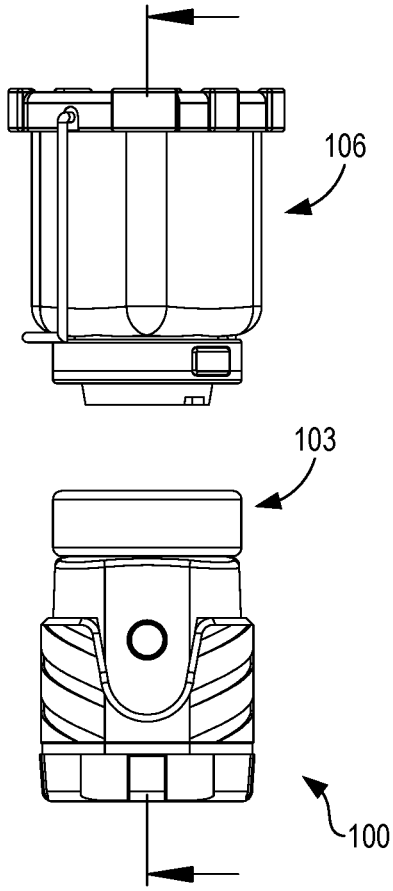
Figure 6:
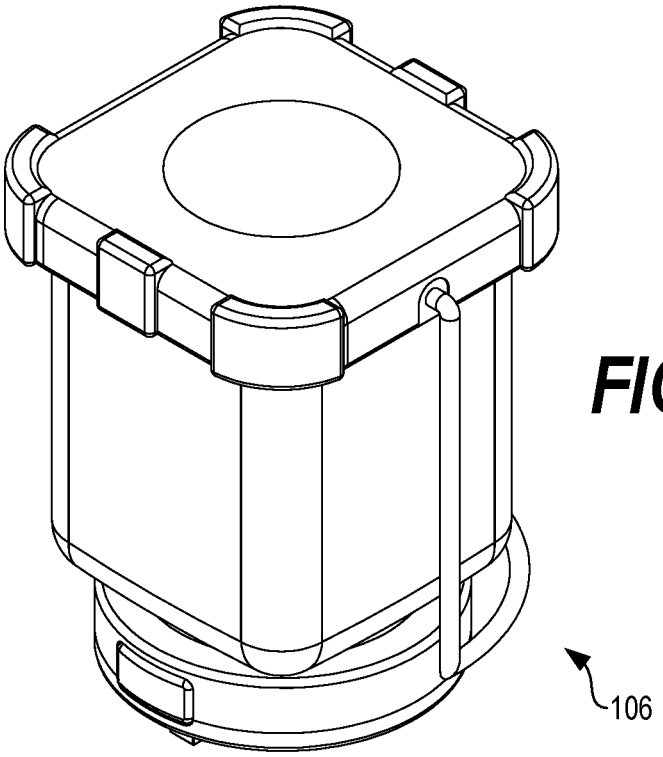
FIG. 6 is a front perspective view of the lantern of the lantern lighting device in accordance with various embodiments of the present disclosure.

Turning now to the figures, FIG. 1 shows a front view of a lantern lighting device 100, FIG. 2 shows a perspective view of the lantern lighting device 100, and FIG. 3 shows a side view of the lantern lighting device 100 according to various embodiments. Referring to FIGS. 1-3 collectively, the lantern lighting device includes a base 103 and a lantern 106. The base 103 includes a base power supply (e.g., one or more base batteries) and a base light emitting element (e.g., one or more base light-emitting diodes (LEDs)). The lantern 106 may be detachably attached to the base 103, and the lantern may include a lantern lighting element (e.g., one or more lantern batteries) and a lantern power supply (e.g., one or more lantern LEDs). The base 103 may be configured to illuminate (e.g., turn on) the base light emitting element when the lantern 106 is detached from the base, and de-illuminate (e.g., turn off) the base light emitting element when the lantern 106 is detachably attached to the base 103, as will be described.

To this end, FIGS. 1-3 show an assembled lantern lighting device 100 with a lantern 106 removable from the base 103 and a base 103 that can operate as an independent lantern. When docked, the lantern 106 may be charged by the base power supply (e.g., one or more batteries stored in the base 103). In some examples, the base 103 does not illuminate when the lantern 106 is docked in the base 103. A secondary illumination (e.g., an illumination of the base 103) may be activated during an undocking sequence, as will be described.

Based on the foregoing, the lantern lighting device 100 can operate and be used as two separate lanterns by undocking the lantern 106 from the base 103. The base 103 may further include a battery cover 109, a grip 112 (e.g., a rubber grip), a base power switch 115, and a base diffuser 118. The lantern 106 may include a lantern diffuser 121 (e.g., a removable lantern diffuser), a lantern power switch 124, and a lantern handle 127. The battery cover 109, when removed, may expose the base power supply.

As shown in FIGS. 1 and 2, the lantern handle 127 of the lantern 106 may project outwards from a bottom portion of the lantern 106. The lantern handle 127 may include a member 130 coupled to a top portion of the lantern 106. The member 130 may include a first member portion 130*a* extending along a vertical axis of the lantern 106 and a second member portion 130*b* projecting outwards at a predetermined angle relative to the first member portion 130*a*. In some examples, the predetermined angle is 90 degrees. In other examples, the angle can be acute, obtuse, or variable.

Referring to now to FIGS. 4A-4C and FIGS. 5A-5B, a sequence of removal of the lantern 106 from the base 103 is shown. Notably, the base 103 may include a threaded connection mechanism such that the lantern 106 is configured to be detached from the base 103 by rotating the lantern a predetermined degree in a first direction, and pulling in a second direction. For instance, the predetermined degree may be 45 degrees (or other suitable amount), the first direction may be a counter-clockwise direction, and the second direction may be a direction away from the base 103. In other words, for example, an undocking of the lantern 106 from the base 103 may comprise rotating the lantern 106 45 degrees counterclockwise and pulling the lantern 106 out of the base 103. In other examples, the undocking of the lantern can be accomplished via clips, hooks, magnets, or other conventional fasteners.

Figure 7:
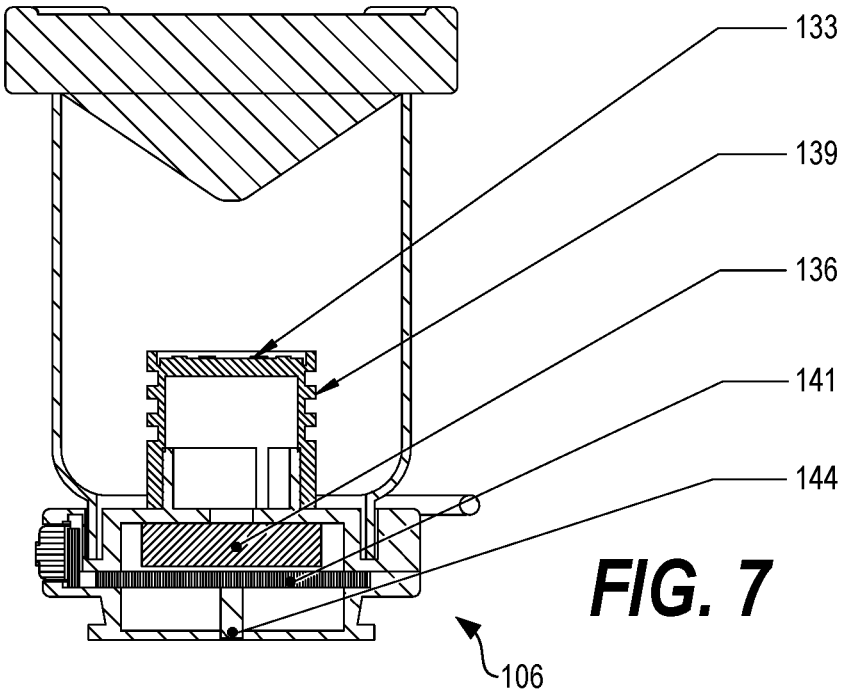
FIG. 7 is a side cross-section view of the lantern of the lantern lighting device in accordance with various embodiments of the present disclosure.
Figure 8:
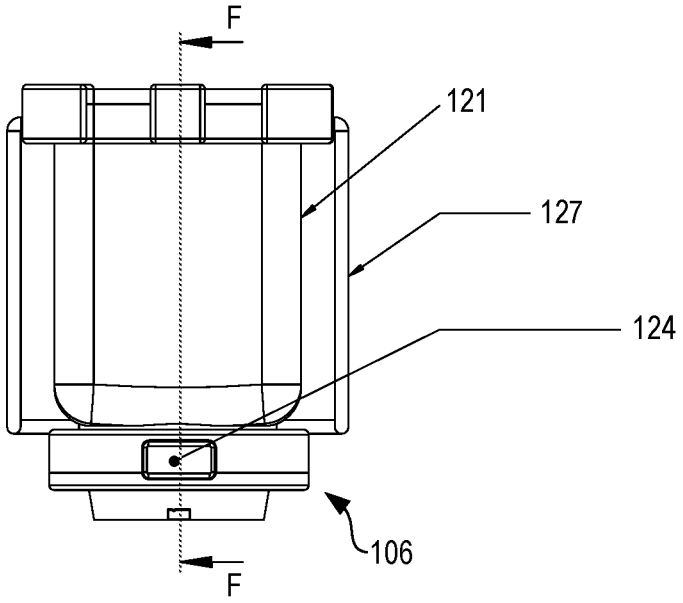
FIG. 8 is a side view of the lantern of the lantern lighting device in accordance with various embodiments of the present disclosure.
Figure 9:
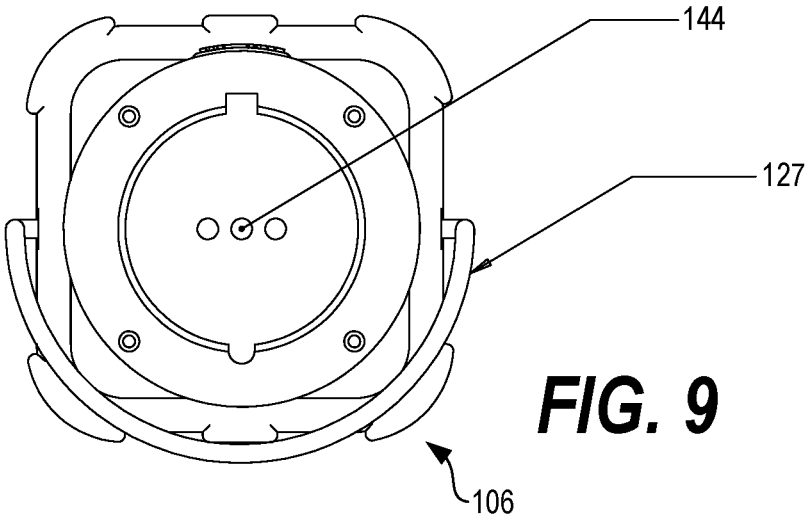
FIG. 9 is a bottom view of the lantern of the lantern lighting device in accordance with various embodiments of the present disclosure.

Moving to FIGS. 6-9, FIG. 6 shows a perspective view of the lantern 106 independent of the base 103, FIG. 7 shows a cross-section of the lantern 106, FIG. 8 shows a side view of the lantern 106, and FIG. 8 shows a bottom view of the lantern 106 according to various embodiments. Referring to these figures collectively, and as noted above, the lantern 106 may further include one or more lantern light emitting elements 133 and a lantern power supply 136. The one or more lantern light emitting elements 133 may include, for example, one or more LEDs or other illumination devices.

Further, the lantern 106 may include a heat sink/light emitting element housing 139. For instance, a heat sink may be integrated into a light emitting element housing with retains heat emitted by the lantern light emitting element 133. The lantern power supply 136 may include one or more of a lithium-polymer (Li-Po) battery or a lithium-ion (Li-ion) battery in some examples, although other types of batteries may be employed (including traditional lead/acid batteries). Further, the lantern 106 may include processing circuitry, which may be implemented in and be part of a lantern printed circuit board 141 in some examples. The lantern 106 may further include lantern charging contacts 144 that may contact and form an electrical connection with corresponding base charging contacts (not shown).

Figure 10:
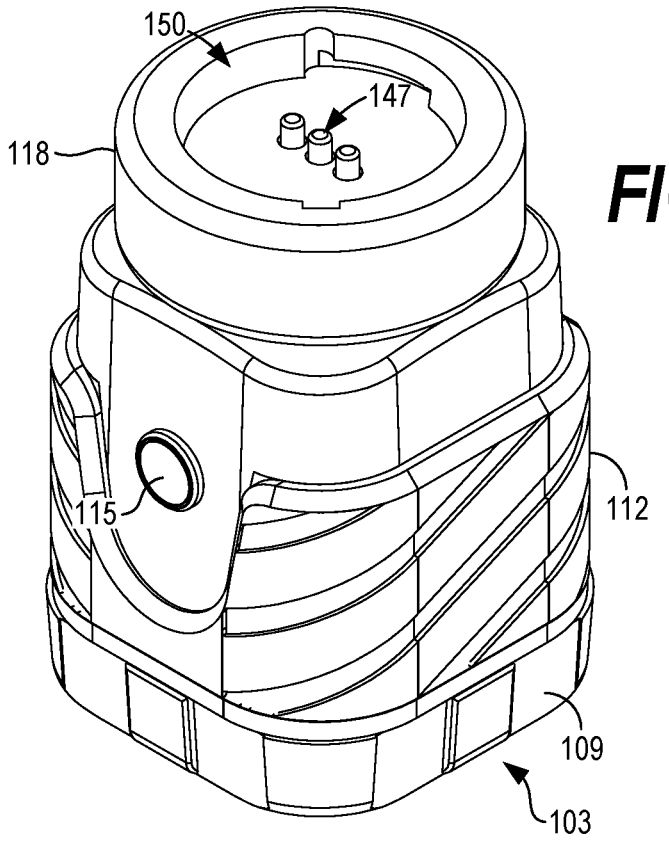
FIG. 10 is a front perspective view of the base of the lantern lighting device in accordance with various embodiments of the present disclosure.
Figure 11:
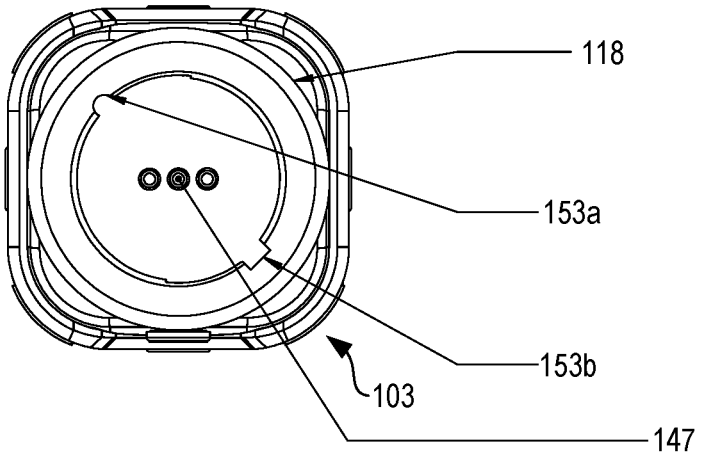
FIG. 11 is a top view of the base of the lantern lighting device in accordance with various embodiments of the present disclosure.
Figure 12:
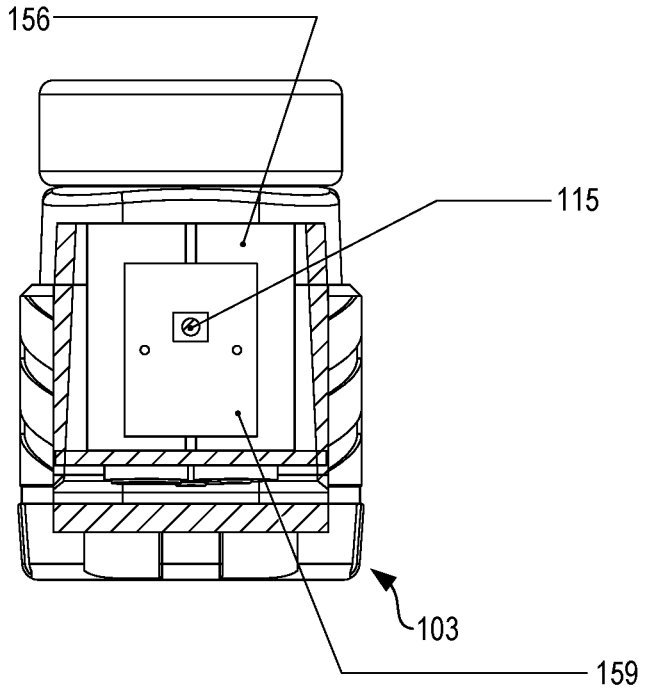
FIG. 12 is a side partial cross-section view of the base of the lantern lighting device in accordance with various embodiments of the present disclosure.
Figure 13:
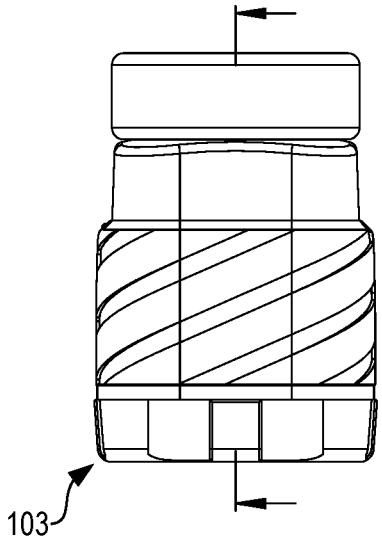
FIG. 13 is a side view of the base of the lantern lighting device in accordance with various embodiments of the present disclosure.
Figure 14:
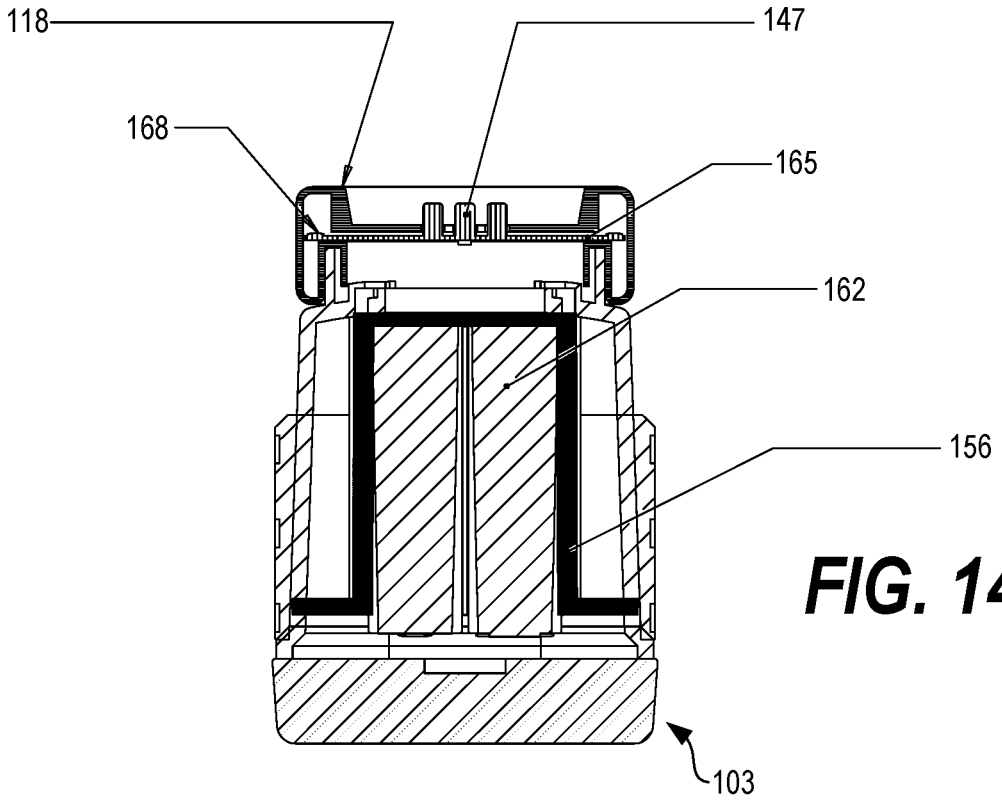
FIG. 14 is a side cross-section view of the base of the lantern lighting device in accordance with various embodiments of the present disclosure.
Figure 15:
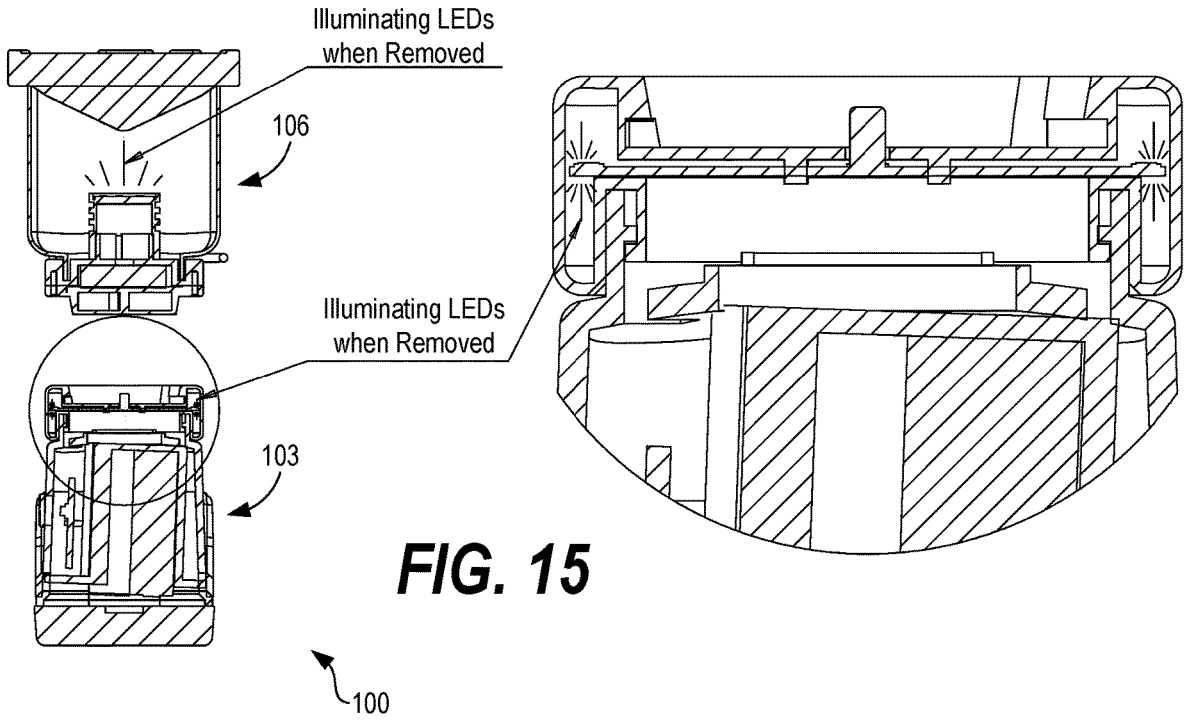
FIG. 15 is a side cross-section view of the lantern and the base of the lantern lighting device in accordance with various embodiments of the present disclosure.

Moving along to FIGS. 10-14, FIG. 10 shows a perspective view of the base 103 independent of the lantern 106, FIG. 11 shows a top view of the base 103, FIG. 12 shows a side, partial cross-section view of the base 103, FIG. 13 shows a side view of the base 103, and FIG. 14 shows a cross-section view of the base 103 according to various embodiments. Referring to these figures collectively, the base 103 may include one or more base charging contacts 147 configured to engage with corresponding ones of the lantern charging contacts 144 of the lantern 106. In some examples, as shown in FIG. 10, the base charging contacts 147 include pins projecting from a bottom surface of a recess 150 positioned at a top of the base 103, where the recess 150 is configured to retain a bottom portion of the lantern 106 therein. As noted above, the base 103 further includes a battery cover 109, a grip 112 (e.g., a rubber grip), a base power switch 115, and a base diffuser 118.

In some examples, a keyed-dock-and-twist connection mechanism can be used to form a connection between the lantern 106 and the base 103. For instance, the keyed-dock-and-twist connection may be implemented using a first aperture 153*a* (e.g., a semi-circular aperture) of a first shape that engages with a similarly shaped projection on the lantern 106 and a second aperture 153*b* of a second shape (e.g., a square or rectangular-shaped aperture) that engages with a similarly shaped projection on the lantern 106. The keyed-dock-and-twist connection mechanism may serve as a safety protocol to ensure that an operator does not reverse the polarity of the base charging contacts 147 and/or the lantern charging contacts 144. This protects the power supplies of the lantern lighting devices 100 and the processing circuitry housed therein.

The base 103 may further include a power supply compartment 156, a base power supply 159, the base power switch 115, and a base printed circuit board 165. A base power supply 162 may be positioned within the power supply compartment 156, which may include one or more batteries (e.g., Li-Po or Li-ion batteries). The processing circuitry of the base 103 may be part of and implemented in the base printed circuit board 165. As such, the base 103 may include processing circuitry configured to detect that the lantern 106 is attached to the base 103 and de-illuminate a base light emitting element 168 when the lantern 106 is attached to the base 103. Similarly, the base 103 may include processing circuitry configured to detect that the lantern 106 is detached from the base 103 and illuminate the base light emitting element 168 when the lantern 106 is detached from the base 103. The coupling of the lantern 106 with the base 103 may be detected or not detected by the processing circuitry using at least one presence sensor (not shown) or a change in inductance or resistance of the base charging contacts 147.

In some embodiments, the processing circuitry of the base 103 is implemented using a single base printed circuit board 165. Similarly, in some embodiments, the processing circuitry of the lantern 106 is implemented using a single lantern printed circuit board 141.

The lantern 106 may include a lantern power switch 124 configured to toggle illumination of the lantern light emitting element 133 and the base 103 may include a base power switch 115 configured to toggle illumination of the base light emitting element 168. The lantern power switch 124 and/or the base power switch 115 may toggle the respective light emitting elements between different modes of operation, such as high-intensity mode, low-intensity mode, moderate-intensity mode, strobing light mode, and so forth.

Turning now to FIG. 14, in some embodiments, when the lantern 106 is docked (or coupled to the base 103), only the lantern light emitting element(s) 133 in the lantern 106 lights up, and the lantern light emitting element 133 is controlled using the lantern power switch 124 located on the base of the lantern 106. On the other hand, when the lantern 106 is undocked (e.g., separated from the base 103), the base light emitting element(s) 168 located in the base diffuser 118 illuminate. This function can serve as a secondary illumination light. The base light emitting element(s) 168 may be oriented so that the entirety of the base diffuser 118 is illuminated in various embodiments. The base light emitting element(s) 168 may be controlled by the base power switch 115 located on a lower or middle portion of the base 103 in some embodiments.

The features, structures, or characteristics described above may be combined in one or more embodiments in any suitable manner, and the features discussed in the various embodiments are interchangeable, if possible. In the following description, numerous specific details are provided in order to fully understand the embodiments of the present disclosure. However, a person skilled in the art will appreciate that the technical solution of the present disclosure may be practiced without one or more of the specific details, or other methods, components, and materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, it is possible that the structure is integrally formed on another structure, or that the structure is "directly" disposed on another structure, or that the structure is "indirectly" disposed on the other structure through other structures.

In this specification, the terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims. The terms "first," "second," etc. are used only as labels, rather than a limitation for a number of the objects.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A lantern lighting device, comprising:

a base comprising a lantern connection mechanism at a top of the base, a base power supply and a base light emitting element, wherein the base forms a bottom portion of the lantern lighting device;

a lantern detachably attached to the lantern connection mechanism at the top of the base, the lantern comprising a lantern lighting element and a lantern power supply; and processing circuitry within the base that illuminates the base light emitting element in response to the lantern being detached from the lantern connection mechanism at the top of the base.

2. The lantern lighting device according to claim 1, wherein the base comprises a threaded connection mechanism such that the lantern is configured to be detached from the base by rotating the lantern a predetermined degree in a first direction, and pulling in a second direction.

3. The lantern lighting device according to claim 2, wherein the predetermined degree comprises at least a 45° angle, the first direction comprises a counter-clockwise direction, and the second direction comprises a direction away from the base.

4. The lantern lighting device according to claim 1, wherein the base comprises a plurality of base charging contacts configured to engage with corresponding ones of a plurality of lantern charging contacts of the lantern.

5. The lantern lighting device according to claim 4, wherein the plurality of base charging contacts comprise pins projecting from a bottom surface of a recess positioned at a top of the base, the recess being configured to retain a bottom portion of the lantern therein.

6. The lantern lighting device according to claim 1, wherein the processing circuitry is configured to:

detect, using a sensor, that the lantern is attached to the base; and de-illuminate the base light emitting element when the lantern is detected to be attached to the base using the sensor.

7. The lantern lighting device according to claim 6, wherein the processing circuitry is implemented using a single printed circuit board (PCB).

8. The lantern lighting device according to claim 1, wherein the processing circuitry is configured to:

detect, using a sensor, that the lantern is detached from the base; and illuminate the base light emitting element when the lantern is detected to be detached from the base using the sensor.

9. The lantern lighting device according to claim 1, wherein the lantern is detected by the processing circuitry using at least one presence sensor.

10. The lantern lighting device according to claim 1, wherein the lantern is detected by a change in inductance or resistance of a plurality of base charging contacts.

11. The lantern lighting device according to claim 1, wherein the lantern comprises a lantern power switch configured to toggle illumination of the lantern light emitting element, and the base comprises a base power switch configured to toggle illumination of the base light emitting element.

12. The lantern lighting device according to claim 1, wherein the lantern light emitting element comprises at least one lantern light emitting diode (LED) and the base light emitting element comprises at least one base light emitting diode.

13. The lantern lighting device according to claim 1, wherein the lantern comprises a removable lantern diffuser and the base comprises a base lantern diffuser.

14. The lantern lighting device according to claim 1, wherein the base power supply comprises at least one first battery, and the lantern power supply comprises at least one second battery.

15. The lantern lighting device according to claim 14, wherein the base comprises a removable battery cover that exposes the base power supply.

16. The lantern lighting device according to claim 1, wherein the lantern comprises a handle, the handle projecting outwards from a bottom portion of the lantern.

17. The lantern lighting device according to claim 16, wherein the handle comprises a member coupled to a top portion of the lantern, the member comprising a first member portion extending along a vertical axis of the lantern and a second member portion projecting outwards at a predetermined angle relative to the first member portion.

18. The lantern lighting device according to claim 17, wherein the predetermined angle is about 90 degrees.

19. The lantern lighting device according to claim 17, wherein the lantern comprises a heat sink integrated into a light emitting element housing.

20. A method, comprising:

providing a lantern lighting device, comprising:

a base comprising a lantern connection mechanism at a top of the base, a base power supply and a base light emitting element, wherein the base forms a bottom portion of the lantern lighting device;

a lantern detachably attached to the lantern connection mechanism at the top of the base, the lantern comprising a lantern lighting element and a lantern power supply; and illuminating, using processing circuitry, the base light emitting element in response to the lantern being detached from the lantern connection mechanism at the top of the base.

* * * * *